US010604388B2

(12) United States Patent
Schulte et al.

(10) Patent No.: US 10,604,388 B2
(45) Date of Patent: Mar. 31, 2020

(54) ASSEMBLY KIT FOR CABLE WINCHES AND METHOD FOR CONVERTING A CABLE WINCH

(71) Applicant: Konecranes Global Corporation, Hyvinkää (FI)

(72) Inventors: Franz Schulte, Herdecke (DE); Thomas Bönker, Unna (DE); Oliver Moll, Solingen (DE); Gereon Imbusch, Mettmann (DE); Ahmet Uzun, Wetter (DE); Torsten Sattler, Sprockhövel (DE); Thomas Kohlenberg, Paderborn (DE)

(73) Assignee: Konecranes Global Corporation, Hyvinkää (FI)

( * ) Notice: Subject to any disclaimer, the term of this patent is extended or adjusted under 35 U.S.C. 154(b) by 142 days.

(21) Appl. No.: 15/737,557

(22) PCT Filed: Jun. 16, 2016

(86) PCT No.: PCT/EP2016/063936
§ 371 (c)(1),
(2) Date: Dec. 18, 2017

(87) PCT Pub. No.: WO2016/202945
PCT Pub. Date: Dec. 22, 2016

(65) Prior Publication Data

US 2018/0194600 A1 Jul. 12, 2018

(30) Foreign Application Priority Data

Jun. 19, 2015 (DE) ..... 10 2015 109 884

(51) Int. Cl.
*B66D 1/28* (2006.01)
*B66D 1/12* (2006.01)

(52) U.S. Cl.
CPC ..... *B66D 1/28* (2013.01); *B66D 1/12* (2013.01); *B66D 2700/0183* (2013.01)

(58) Field of Classification Search
CPC .... B66D 1/12; B66D 1/28; B66D 2700/0183; B66D 2700/0166; B66D 2700/0175
See application file for complete search history.

(56) References Cited

U.S. PATENT DOCUMENTS 3,537,686 A * 11/1970 McKendrick ..... B66D 3/18 254/264
2003/0205703 A1* 11/2003 McCormick ..... B66B 1/32 254/267

(Continued)

FOREIGN PATENT DOCUMENTS

CN 202030475 U 11/2011
CN 202164068 U 3/2012

(Continued)

OTHER PUBLICATIONS

Preliminary Report on Patentability of the International Searching Authority in English from corresponding Patent Cooperation Treaty (PCT) Application No. PCT/EP2016/063936, English translation completed Dec. 19, 2017.

(Continued)

*Primary Examiner* — Emmanuel M Marcelo
(74) *Attorney, Agent, or Firm* — Gardner, Linn, Burkhart & Ondersma LLP

(57) ABSTRACT

An assembly kit for cable winches, comprising a cable drum, a drive motor, a transmission unit, and a supporting frame, where the assembly kit includes various transmission housing parts for the transmission unit in order to enable the assembly of a cable winch in a C shape or in a quasi-coaxial shape. A method for converting a cable winch, comprising a cable drum, a drive motor, a transmission unit, and a supporting frame, between a C-shape arrangement and a (Continued)

quasi-coaxial-shape arrangement, for which purpose the transmission unit, in the case of the use of different housings, in particular specific housing shells that can be assembled in order to form the different housings, is assembled differently for the C shape or coaxial shape while the same parts, in particular identical shafts, are used within the particular housing.

20 Claims, 5 Drawing Sheets

(56) References Cited

U.S. PATENT DOCUMENTS

| | | | | |
|---|---|---|---|---|
| 2003/0230744 | A1* | 12/2003 | Rawlinson | A01B 59/066 254/323 |
| 2008/0023681 | A1* | 1/2008 | Cunningham | B66D 3/20 254/362 |
| 2009/0308826 | A1* | 12/2009 | Kempf | B66C 9/02 212/270 |
| 2017/0320709 | A1* | 11/2017 | Frazier | B66D 1/22 |

FOREIGN PATENT DOCUMENTS

| | | | |
|---|---|---|---|
| CN | 202848961 | U | 4/2013 |
| CN | 103183293 | A | 7/2013 |
| CN | 204096984 | U | 1/2015 |
| CN | 204138251 | U | 2/2015 |
| CN | 105164045 | A | 12/2015 |
| DE | 42513 | A3 | 6/1965 |
| DE | 1951272 | U | 12/1966 |
| DE | 19530891 | A1 | 2/1997 |
| DE | 102005046900 | A1 | 4/2007 |
| DE | 102010048946 | A1 | 4/2012 |
| EP | 0189525 | A2 | 8/1986 |
| EP | 0557056 | A1 | 8/1993 |
| JP | S56056497 | A | 5/1981 |
| JP | 2000110895 | A | 4/2000 |

OTHER PUBLICATIONS

Konstruktionslehre—Methoden und Anwendung; Pahl/Beitz; ISBN 3-540-56194-3.

International Search Report and Written Opinion of the International Searching Authority from corresponding Patent Cooperation Treaty (PCT) Application No. PCT/EP2016/063936, indicated completed on Sep. 14, 2016.

* cited by examiner

ASSEMBLY KIT FOR CABLE WINCHES AND METHOD FOR CONVERTING A CABLE WINCH

The present application claims the priority benefits of International Patent Application No. PCT/EP2016/063936, filed Jun. 16, 2016, and claims benefit of German Application No. DE 102015109884.9, filed on Jun. 19, 2015.

DESCRIPTION OF THE INVENTION

The invention relates to a construction or assembly kit for cable winches comprising a cable drum, a drive motor, a transmission unit and a supporting frame.

The use of cable winches of substantially two different designs is known.

The main variation of the different designs is the so-called C shape in which the drive motor is disposed below (or above) the cable drum or the cable winch mounted in the supporting frame so that an approximate C shape is produced as seen from the side. In this case, the transmission is usually disposed on the lateral face plates of the supporting frame.

The other variation of the different designs is the so-called coaxial shape in which the drive motor is flange-mounted, laterally almost as an extension of the cable winch axis or cable drum drive shaft, on the face plates of the supporting frame with the transmission being interpositioned. In this case, the motor driven shaft and the cable drum drive shaft are disposed coaxially to one another.

The C shape has the advantage of a compact arrangement, while the coaxial shape is slim line.

Cable winches in the C shape or of a type of coaxial shape are known e.g. from DE 10 2010 048 946 A1, DE 10 2005 046 900 A1, DE 195 30 891 A1 and DD 42 513 A3.

In addition, construction kits are generally known e.g. from the text book "Konstruktionslehre-Methoden and Anwendung" ["Design—Methods and Application"] by Pahl and Beitz, 3rd edition, 1993, page 589 ff.

From DE 1 951 272 U a type of construction kit system relating to add-on fine motion transmissions for winches is known. In this case a drive motor can be formed, either on its own without an add-on fine motion transmission or with an add-on fine motion transmission in a short C shape variation or a long C shape variation. Different transmission housings, pinions and gear wheels are used in order to assemble the respective C shape variation. The drive motor can also be disposed in each case on different sides of the transmission of the winch, thus forming a C shape variation.

SUMMARY OF THE INVENTION

The object of the invention is to offer a way of allowing the effort for the parallel provision of different designs of cable winches, in particular the C shape and coaxial shape or a similar design, to be reduced.

In accordance with an embodiment of the invention, a construction kit for cable winches is provided, comprising a cable drum, a drive motor, a transmission unit and a supporting frame, wherein the construction kit includes different transmission housing parts for the transmission unit in order to permit assembly of a cable winch in the C shape or quasi-coaxial shape as desired.

Quasi-coaxial or a design in quasi-coaxial shape is understood in the present case to mean an arrangement in which the motor driven shaft, i.e. the output shaft of the drive motor, and a shaft forming the axis of rotation of the cable drum are not coaxial in terms of a cable drum drive shaft (cf. above) but lie or are disposed displaced or offset with respect to one another by at least 5 cm but less than 50 cm, depending on the specific implementation and in particular load capacity. The offset of the shafts with respect to one another can be approximately at a right angle but also diagonal.

In other words, it has been recognised in accordance with the invention that when complete coaxiality is dispensed with and merely an almost coaxial arrangement or quasi-coaxial shape is sufficient, it is possible to manage merely with different transmission housing parts for the C shape and quasi-coaxial shape since then the remaining transmission components can merely be fitted together in a different arrangement in order to be converted between a C shape and a quasi-coaxial shape or to determine the final design during assembly and to fix it as a C shape or quasi-coaxial shape merely by the selection of the corresponding transmission housing part.

In a constructionally simple manner, provision is thus made that, as different transmission housing parts, a first housing for the C shape and a different second housing for the quasi-coaxial shape are provided, the first housing is formed in such a way that the transmission unit can be assembled as a first transmission unit for the C shape and therewith the design of the cable winch to be assembled can be fixed as the C shape, and the second housing is formed in such a way that the transmission unit can be assembled as a second transmission unit for the quasi-coaxial shape and therewith the design of the cable winch to be assembled can be fixed as the quasi-coaxial shape.

Provision is advantageously made that the first housing can be fitted together from first housing shells and the second housing can be fitted together from second housing shells. In this case, the first housing is preferably more elongate than the second housing.

In a constructionally simple manner, provision is also made that the housings are formed in such a way that in order to form the first or second transmission unit in each case identical shafts, in particular an output shaft, preferably additionally two intermediate shafts and particularly preferably additionally an input shaft, can be mounted in the corresponding housing in a different arrangement for the C shape and the quasi-coaxial shape.

Furthermore, provision is advantageously made that the construction kit for both transmission units includes the same parts in the form of shafts, in particular an output shaft, preferably additionally two intermediate shafts and particularly preferably additionally an input shaft, for assembly of the cable winch, in particular of the corresponding transmission unit, in the C shape or quasi-coaxial shape.

In this way, in deviating from the previous procedure, it is possible merely to fit together the transmission or the transmission unit differently within specific housing shells for the C shape and quasi-coaxial shape while the other parts (shafts, pinions, etc.) remain the same. Therefore, only different transmission housing parts, i.e. the housing or corresponding housing shells which can be fitted together, need to be stored.

In an advantageous manner, therefore, only one set of transmission components, in particular shafts, pinions and gear wheels, needs to be stored regardless of the selected design for a respective transmission ratio. Bearings and other standard parts can deviate if necessary depending on the design.

The remaining parts of the cable winches, such as the cable drum, drive motor and supporting frame, can remain the same, which is a deviation from the previous procedure. By reason of the offset which has been taken into account, identical components can be used for both designs, in particular even in the transmission or transmission unit itself. Only the housing shells and the arrangement of the transmission parts in the shells are specific for the respective design.

The transmission housing parts or housing shells thus serve, in addition to the reception and mounting of the transmission components, also to provide attachment or connection and fastening points in order to achieve the respective design during adding-on of the drive and cable drum together with the supporting frame.

If necessary—according to need—another input shaft can also be used, in particular depending on the requirement for quasi-coaxiality, in order to increase the degree of approximation to precise coaxiality, i.e. to keep the distance between the axes of rotation of the shafts as small as possible and at the same time to benefit from the advantage of simple convertibility. In particular, a so-called overhung mounting of the input shaft, i.e. a one-sided mounting, is suitable for this purpose.

The construction kit can thus additionally include different input shafts for the C shape and quasi-coaxial shape.

Provision is advantageously made that the shafts of the transmission unit in the C shape are arranged lying almost on a line as seen in their longitudinal direction, preferably with two intermediate shafts between an input shaft and an output shaft. The arrangement of the transmission shafts (or the longitudinal centre axes thereof) for the C shape almost on a line can clearly be seen in the front view of FIG. 2. In other words, the shafts extend in parallel with one another approximately within a common plane.

In contrast to this, the transmission shafts in the quasi-coaxial shape are disposed in a nested manner as shown in FIG. 4. Provision is thus advantageously made that the shafts of the transmission unit in the quasi-coaxial shape are disposed in a nested manner, preferably with an input shaft between an output shaft and two intermediate shafts.

A modular construction is thus achieved and all remaining add-on parts can be used in both designs.

In accordance with an embodiment of the invention, a method is also provided for converting a cable winch, including a cable drum, a drive motor, a transmission unit and a supporting frame, between a C shape arrangement and a quasi-coaxial shape arrangement, for which purpose the transmission unit is merely fitted together differently within the respective housing using different housings, in particular specific housing shells, which can be fitted together to form the different housings, for the C shape or coaxial shape using the same parts, in particular identical shafts.

Further features and details of the invention will be apparent from the following description of the figures.

DESCRIPTION OF THE PREFERRED EMBODIMENTS

Figure 1:
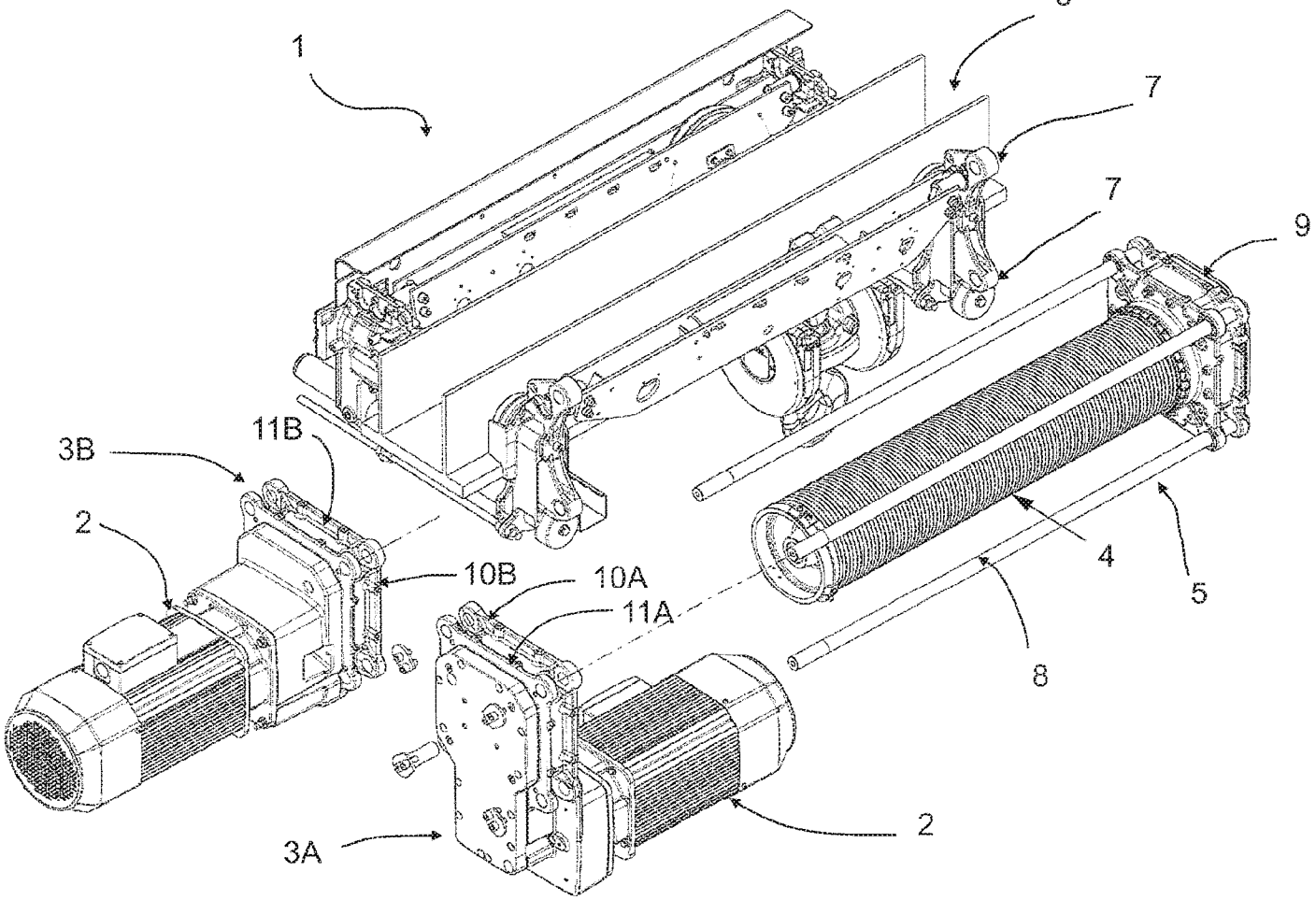
FIG. 1 is a perspective and schematic exploded view of a construction kit in accordance with an embodiment of the invention for cable winches.

FIG. 1 shows a perspective and schematic exploded view of a construction kit 1 in accordance with an embodiment of the invention for cable winches. This overview shows the modular construction of the construction kit 1 in accordance with the invention or of the cable winch which can be fitted together from the parts of the construction kit 1 in the C shape or quasi-coaxial shape as desired. The construction kit designated as a whole by 1 is thus a type of modular cable winch system and comprises as essential parts a drive motor 2 or, as shown in FIG. 1, two drive motors 2 which are preferably formed as electric motors, and the components mentioned below, with which a first transmission unit 3A for the C shape and a second transmission unit 3B for the quasi-coaxial shape can be assembled. By means of the driving connection of the drive motor 2 to one of the two transmission units 3A, 3B, a motor-transmission unit arrangement can be produced and therefore the design of the cable winch to be assembled or produced can be fixed as a C shape or quasi-coaxial shape. In order to form the C shape, the first transmission unit 3A comprises first housing shells 11A which can be fitted together to form a first housing 10A of the transmission unit 3A. In a corresponding manner, in order to form the quasi-coaxial shape, the second transmission unit 3B includes second housing shells 11B which can be fitted together to form a second housing 10B of the second transmission unit 3B. The differences between the housings 10A and 10B or the housing shells 11A and 11B thereof are explained in more detail below with reference to the corresponding figures.

The construction kit 1 also includes a cable drum 4 and a supporting frame 5 by which the cable drum 4 is received and rotatably mounted. The cable drum 4 can be driven by the corresponding motor-transmission unit arrangement. The supporting frame 5 supporting the cable drum 4 can be fitted together with the corresponding motor-transmission unit arrangement to form a cable winch in the C shape or quasi-coaxial shape as desired. In the present case, for better understanding the illustration indicates that, in order to form a monorail travelling crane, the cable winch can be attached to the bridge 6 thereof.

For connection to the supporting frame 5 of the cable winch, the bridge 6 includes pierced fastening points 7 which are provided in pairs on the outside in the end region on the long sides.

For this purpose, the rods 8 of the supporting frame 5 pass through the fastening points 7.

The supporting frame 5 comprises a substantially rectangular or square face plate 9 which receives one of three rods 8 respectively in its corners and also centrally provides a mounting for the cable drum 4.

On the side facing away from the face plate 9, the three rods 8 engage in the corresponding housing 10A or 10B of the respective transmission unit 3A or 3B in an analogous manner in order to be able to drivingly connect the transmission unit 3A, 3B to the cable drum 4.

Depending on the desired design, the drive motor 2 can be flange-mounted on the transmission unit 3A, 3B or the housing 10A, 10B thereof on the same side as the cable drum 4 (C shape) or on the opposite side of the cable drum 4 (quasi-coaxial shape).

The transmission units 3A and 3B include, in addition to the different housing shells 11A and 11B of the respective housing 10A, 10B for the C shape or quasi-coaxial shape, other like parts, in particular shafts, pinions, gear wheels etc. which are merely arranged differently within the respective housing shells 11A (C shape) or 11B (quasi-coaxial shape). For this purpose, the housing shells 11A, 11B are dimensioned in a correspondingly different manner so that the required mounting and arrangement of the parts described below is possible therein in order to form the C shape or quasi-coaxial shape.

This is explained hereinunder with reference to FIGS. 2 to 5.

Figure 2:
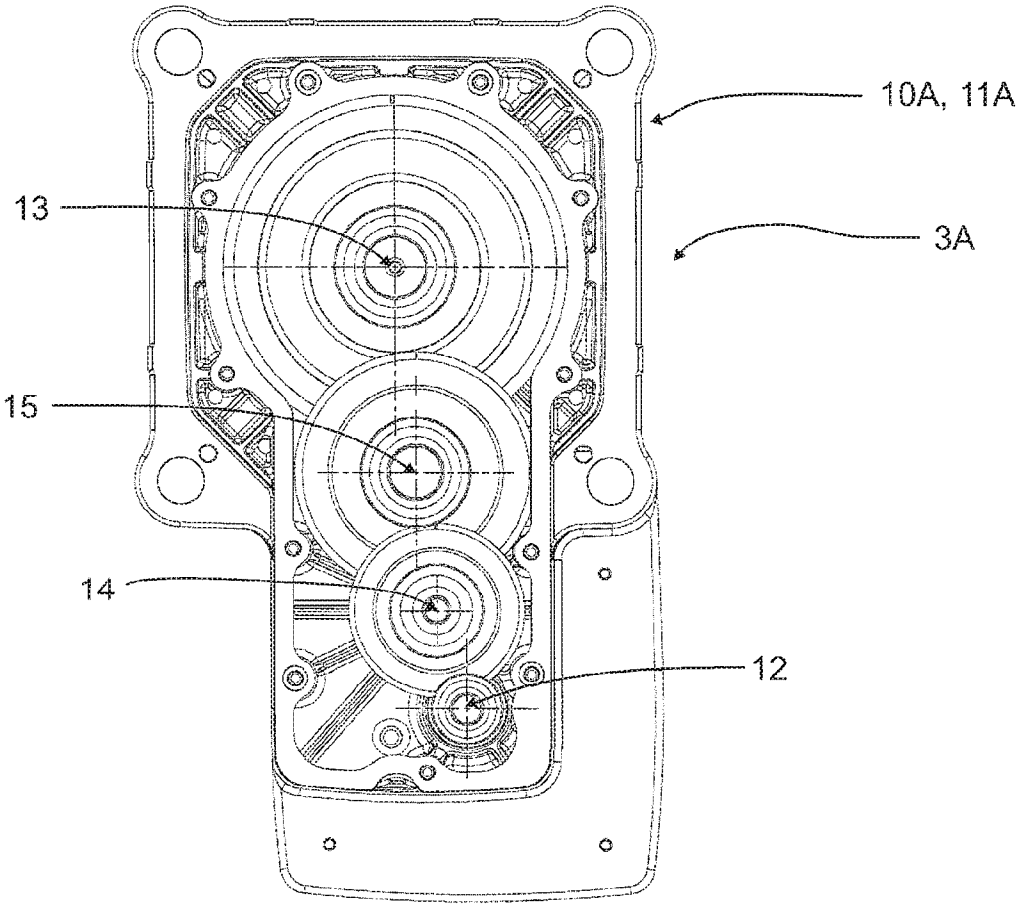
FIG. 2 is a front view of a motor-transmission unit arrangement for the C shape with the transmission housing cover open.
Figure 3:
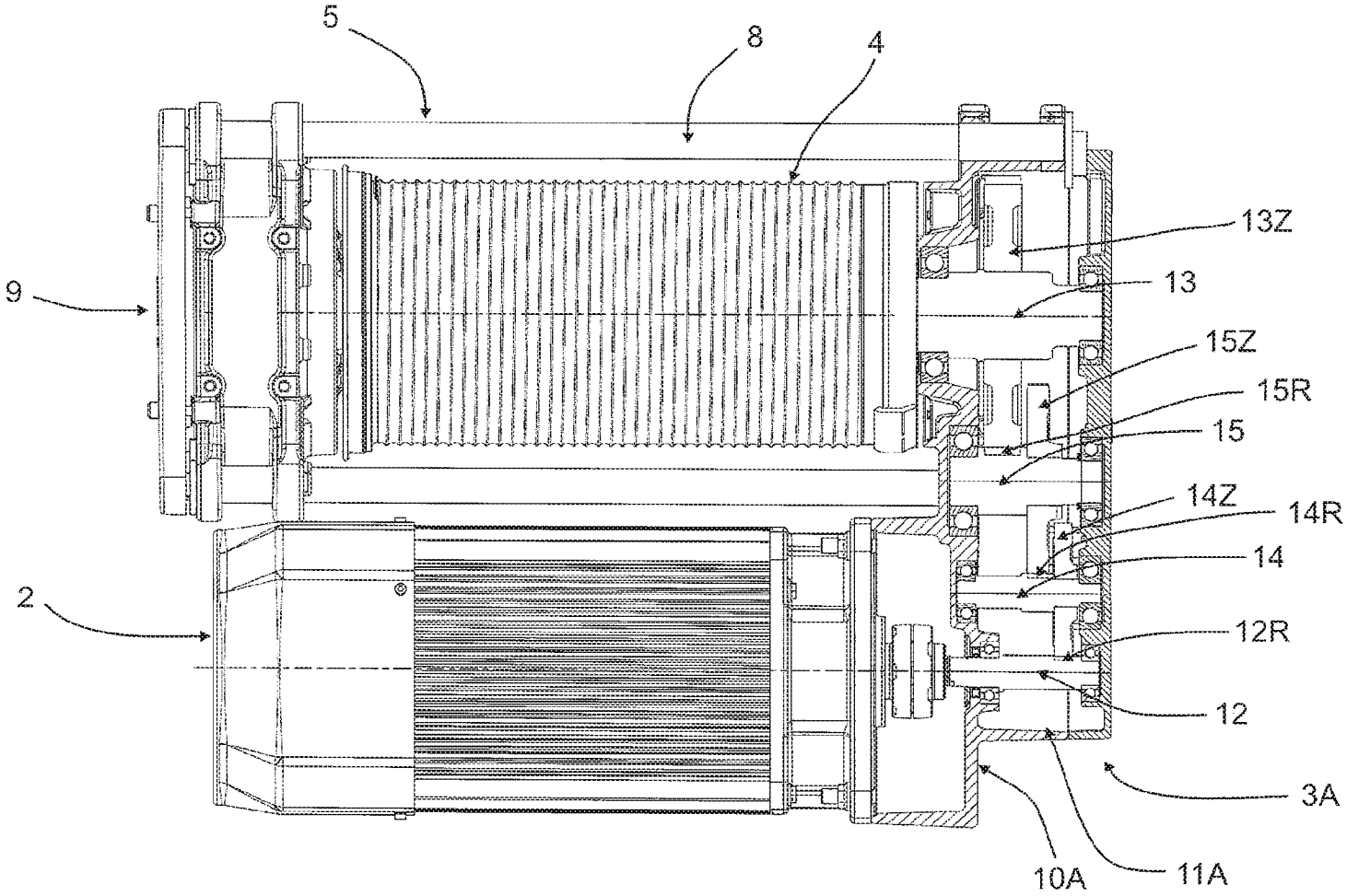
FIG. 3 is a partial cross-sectional view through the motor-transmission unit arrangement for the C shape of FIG. 2.
Figure 4:
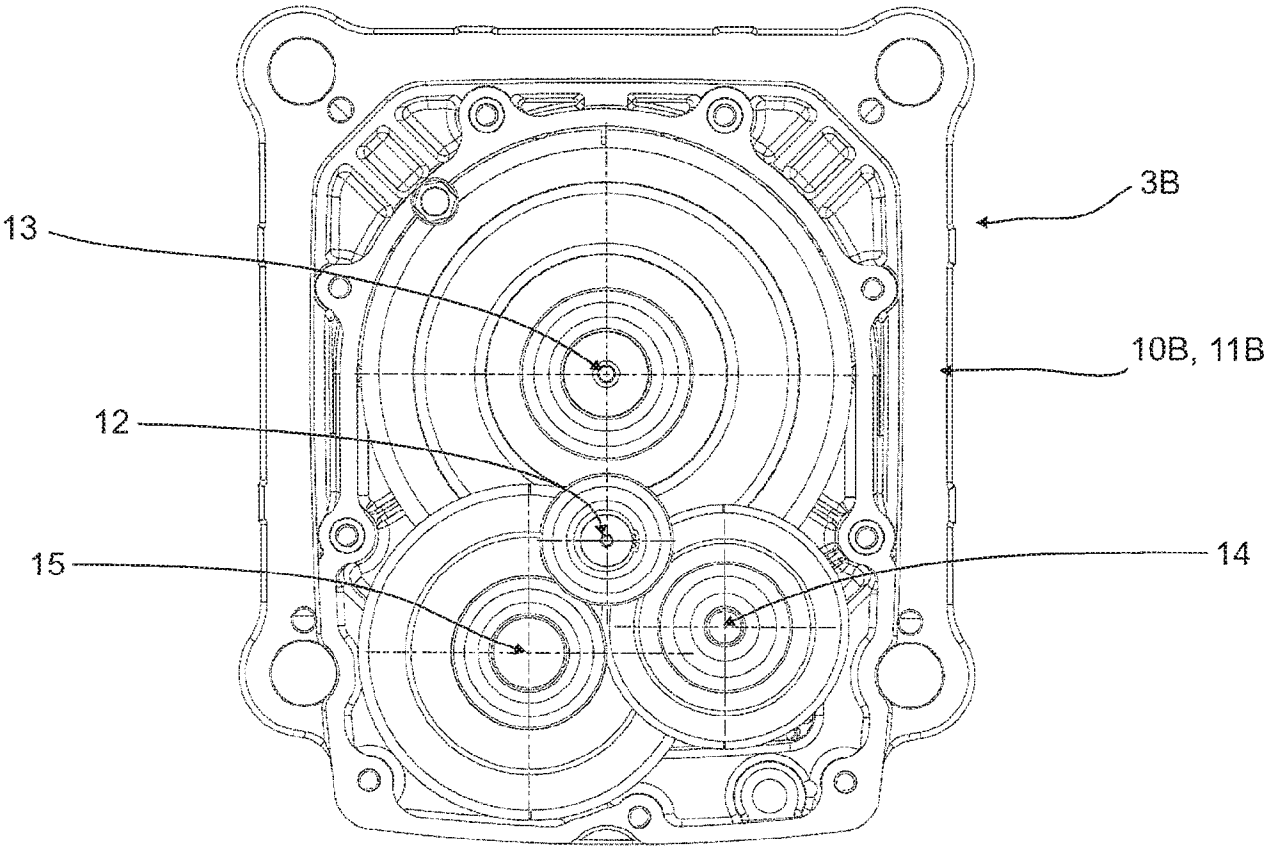
FIG. 4 is a front view of a motor-transmission unit arrangement for the quasi-coaxial shape with the drive flange removed and FIG. 5 is a partial cross-sectional view through the motor-transmission unit arrangement for the quasi-coaxial shape.
Figure 5:
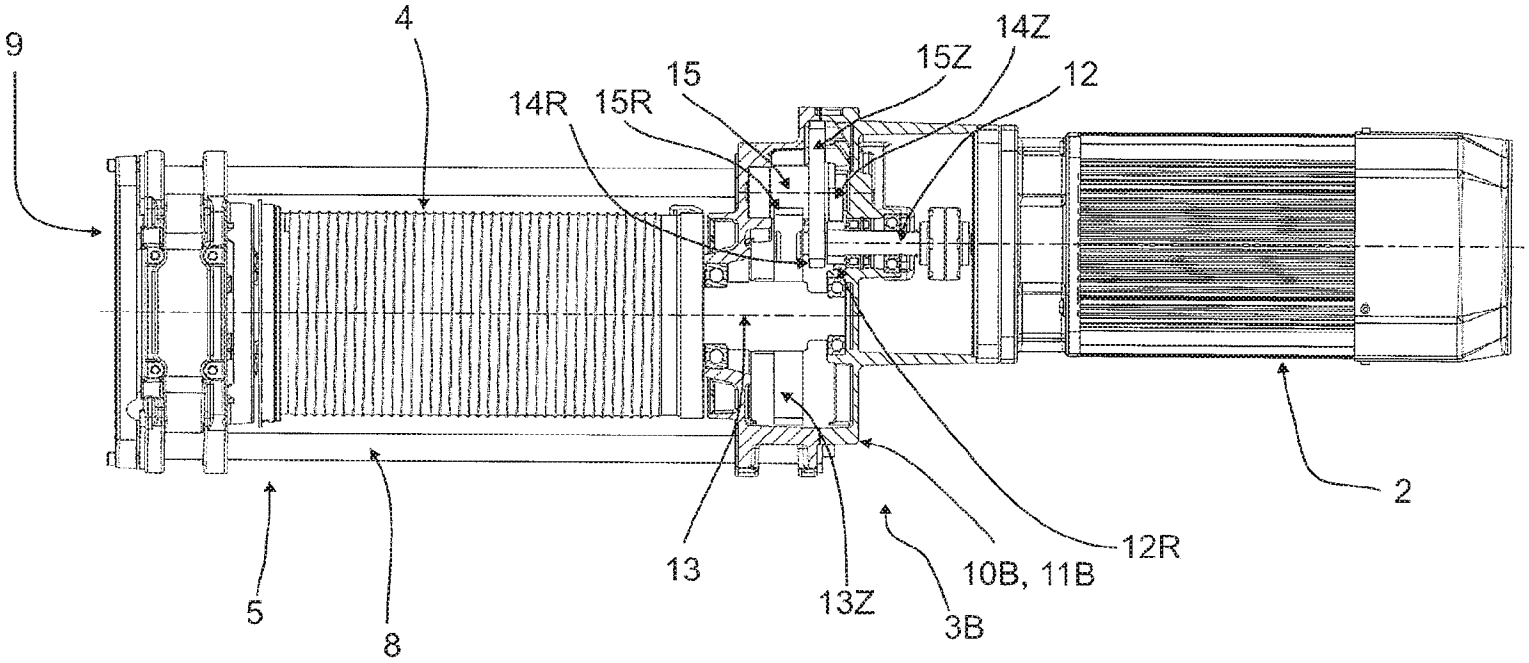

In FIGS. 2 and 3 the C shape is shown in more detail, whereas in FIGS. 4 and 5 the quasi-coaxial shape is shown in more detail.

It will be seen that each transmission unit 3A, 3B always includes the following four shafts: a first shaft 12 which serves as an input shaft of the transmission unit 3A, 3B and can be drivingly connected to the motor driven shaft, a second shaft 13 which serves as an output shaft of the transmission unit 3A, 3B and therefore as a cable drum drive shaft, and a third shaft 14 and a fourth shaft 15 which each serve as an additional shaft.

In the C shape design, the shafts 12 to 15 lie with their longitudinal centre axes approximately on an imaginary line in the illustration of FIG. 2, i.e. as seen in the longitudinal direction of the shafts 12 to 14. For this purpose, the shafts 12 to 14 are arranged in such a way that they extend in parallel with one another approximately within a common plane. In so doing, the two shafts 14, 15 serving as intermediate shafts are disposed, as seen in the longitudinal direction thereof, between the shaft 12 serving as an input shaft and the shaft 13 serving as an output shaft. For this purpose, the first housing 10A for the C shape is more elongate than the second housing 10B for the quasi-coaxial shape since the corresponding offset between the shafts 12 and 13 mounted in the housing 10A must be achieved in order to achieve the C shape.

In contrast, in the quasi-coaxial shape design, the shafts 12 to 15 appear to be nested. In this case, the input shaft (shaft 12) is disposed between the output shaft (shaft 13) and the two intermediate shafts (shafts 14 and 15). In this way, the housing 10B can be less elongate than the housing 10A since only the small offset required for this quasi-coaxial shape must be achieved between the shafts 12 and 13 mounted in the housing 10B and therefore the nested arrangement of the shafts 12 to 15 is more compact than the arrangement of the shafts 12 to 15 for the C shape. In this way, compared with the C shape, the quasi-coaxial shape is similarly slimline like a complete coaxial shape. In particular, in this case the intermediate shafts (shafts 14 and 15), as seen in their longitudinal direction, are disposed around the input shaft (shaft 12) and in particular on one side of the input shaft (shaft 12) and the output shaft on an opposite side of the input shaft. In this way, the input shaft is disposed between the output shaft and the two intermediate shafts. In contrast, in the C shape both intermediate shafts (shafts 14 and 15) are disposed on a side of the input shaft (shaft 12) facing the output shaft (shaft 13).

The shafts 12, 14 and 15 each comprise a pinion 12R, 14R, 15R designated with the addition R, and a gear wheel 13Z, 14Z, 15Z designated with the addition Z is respectively allocated to the shafts 13, 14 and 15. The pinions 12R, 14R, 15R and the gear wheels 13Z, 14Z, 15Z mesh in a corresponding manner as indicated in FIGS. 3 and 5.

Both in the C shape and also in the quasi-coaxial shape, the shafts 12 to 15 similarly mesh with their pinions R or gear wheels Z from the input shaft to the output shaft in the sequence 12-14-15-13 or 12R 14Z 14R 15Z 15R 13Z, so that the same transmission ratio is achieved regardless of the design.

As already described above, the first shaft 12 serving as an input shaft can be formed differently for the two designs, but the remaining shafts 13, 14, 15 with their pinions and gear wheels are used in the same way, i.e. identically, for both designs and are disposed in a correspondingly different way in the respective housing 10A or 10B only as described depending on the design.

The invention claimed is:

1. A construction kit for cable winches comprising a cable drum, a drive motor, a transmission unit and a supporting frame, wherein the construction kit includes different transmission housing parts for the transmission unit in order to permit assembly of a cable winch in a C shape or quasi-coaxial shape as desired, for which purpose, a first housing for the C shape and a different second housing for the quasi-coaxial shape are provided as different transmission housing parts, the first housing is formed in such a way that the transmission unit can be assembled as a first transmission unit for the C shape and therewith the design of the cable winch to be assembled can be fixed as the C shape, and the second housing is formed in such a way that the transmission unit can be assembled as a second transmission unit for the quasi-coaxial shape and therewith the design of the cable winch to be assembled can be fixed as the quasi-coaxial shape.

2. The construction kit as claimed in claim 1, wherein the first housing can be fitted together from first housing shells and the second housing can be fitted together from second housing shells.

3. The construction kit as claimed in claim 2, wherein the first housing is more elongate than the second housing.

4. The construction kit as claimed in claim 3, wherein the housings are formed in such a way that in order to form the first or second transmission unit in each case identical shafts, comprising an output shaft, two intermediate shafts and an input shaft can be mounted in the corresponding housing in a different arrangement for the C shape and the quasi-coaxial shape.

5. The construction kit as claimed in claim 3, wherein the construction kit for both transmission units includes the same parts in the form of shafts, comprising an output shaft, two intermediate shafts and an input shaft for assembly of the cable winch, of the corresponding transmission unit in the C shape or quasi-coaxial shape.

6. The construction kit as claimed in claim 3, wherein the construction kit additionally includes different input shafts for the C shape and quasi-coaxial shape.

7. The construction kit as claimed in claim 3, wherein a plurality of shafts of the transmission unit in the C shape are arranged lying almost on a line as seen in their longitudinal direction, with two intermediate shafts between an input shaft and an output shaft.

8. The construction kit as claimed in claim 3, wherein a plurality of shafts of the transmission unit in the quasi-coaxial shape are disposed in a nested manner, with an input shaft between an output shaft and two intermediate shafts.

9. The construction kit as claimed in claim 1, wherein the first housing is more elongate than the second housing.

10. The construction kit as claimed in claim 1, wherein the housings are formed in such a way that in order to form the first or second transmission unit in each case identical shafts can be mounted in the corresponding housing in a different arrangement for the C shape and the quasi-coaxial shape.

11. The construction kit as claimed in claim 10, wherein the shafts comprise an output shaft, two intermediate shafts and an input shaft.

12. The construction kit as claimed in claim 1, wherein the construction kit for both transmission units includes the same parts in the form of shafts for assembly of the cable winch of the corresponding transmission unit in the C shape or quasi-coaxial shape.

13. The construction kit as claimed in claim 12, wherein the shafts comprise an output shaft, two intermediate shafts and an input shaft.

14. The construction kit as claimed in claim 1, wherein the construction kit additionally includes different input shafts for the C shape and quasi-coaxial shape.

15. The construction kit as claimed in claim 1, wherein the shafts of the transmission unit in the C shape are arranged lying almost on a line as seen in their longitudinal direction.

16. The construction kit as claimed in claim 15, further comprising two intermediate shafts between an input shaft and an output shaft.

17. The construction kit as claimed in claim 1, wherein a plurality of shafts of the transmission unit in the quasi-coaxial shape are disposed in a nested manner.

18. The construction kit as claimed in claim 17, wherein the shafts of the transmission unit comprise an input shaft between an output shaft and two intermediate shafts.

19. A method for converting a cable winch, including a cable drum, a drive motor, a transmission unit, shafts and a supporting frame between a C shape arrangement and a quasi-coaxial shape arrangement, said method comprising:

providing different transmission housing parts comprising a first housing for the C shape and a different second housing for the quasi-coaxial shape; and fitting the transmission unit within a respective one of the first housing and second housing to form the C shape or quasi-coaxial shape using the same shafts.

20. The method of claim 19, wherein the first housing comprises first housing shells and wherein the second housing comprises second housing shells, and wherein the method further comprises fitting the first housing shells together to form the first housing and fitting the second housing shells together to form the second housing.

* * * * *